US006193051B1

(12) United States Patent
Focke

(10) Patent No.: US 6,193,051 B1
(45) Date of Patent: Feb. 27, 2001

(54) HANDLING INSTALLATION, IN PARTICULAR FOR CIGARETTES

(75) Inventor: Heinz Focke, Verden (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/242,883

(22) PCT Filed: Sep. 1, 1997

(86) PCT No.: PCT/EP97/04731

§ 371 Date: Apr. 13, 1999

§ 102(e) Date: Apr. 13, 1999

(87) PCT Pub. No.: WO98/09543

PCT Pub. Date: Mar. 12, 1998

(30) Foreign Application Priority Data

Sep. 2, 1996 (DE) ..... 196 35 598

(51) Int. Cl.[7] ..... B65G 1/00

(52) U.S. Cl. ..... 198/347.3; 198/358; 198/347.1; 131/282

(58) Field of Search ..... 198/358, 347.1, 198/347.2, 348.3; 131/282, 283, DIG. 909

(56) References Cited

U.S. PATENT DOCUMENTS

| | | | | |
|---|---|---|---|---|
| 4,042,094 | | 8/1977 | Schermmund . | |
| 4,229,137 | * | 10/1980 | Molins | 414/786 |
| 4,280,611 | | 7/1981 | Molins et al. . | |
| 4,344,520 | * | 8/1982 | Czoch et al. | 198/347 |
| 4,506,917 | | 11/1977 | Seragnoli . | |
| 4,507,040 | * | 3/1985 | Baese et al. | 414/403 |
| 4,790,422 | * | 12/1988 | Clarke et al. | 198/347 |
| 4,865,179 | * | 9/1989 | Carter et al. | 198/347 |
| 4,962,840 | | 10/1990 | Miura et al. . | |
| 5,361,888 | * | 11/1994 | Brown et al. | 198/347.3 |
| 5,439,092 | * | 8/1995 | Hierons | 198/347.3 |
| 5,845,758 | * | 12/1998 | Bryant et al. | 198/347.3 |
| 5,915,522 | * | 6/1999 | Clarke | 198/347.3 |

FOREIGN PATENT DOCUMENTS

| | | | | |
|---|---|---|---|---|
| 23 60 991 | | 6/1975 | (DE) . | |
| 25 20 222 | | 11/1976 | (DE) . | |
| 2716823 | * | 11/1977 | (DE) | 198/313 |
| 2718125 | * | 11/1977 | (DE) | 198/347.1 |
| 33 43 529 | | 6/1984 | (DE) . | |
| 33 45 117 | | 6/1984 | (DE) . | |
| 36 40 046 | | 5/1987 | (DE) . | |
| 33 38 183 | | 4/1988 | (DE) . | |
| 136 827 | | 4/1985 | (EP) . | |
| 2 358 115 | | 2/1978 | (FR) . | |

* cited by examiner

*Primary Examiner*—Christopher P. Ellis
*Assistant Examiner*—Rashmi Sharma
(74) *Attorney, Agent, or Firm*—Sughrue, Mion, Zinn, Macpeak & Seas, PLLC

(57) ABSTRACT

A handling installation disclosed, in particular for cigarettes. Known installations for handling cigarettes have a reservoir for temporarily storing the cigarettes, a maker (10) for the cigarettes and a packer (11). The maker (10) is arranged upstream of the reservoir (12) and the packer (11) is arranged downstream of the reservoir (12). In known installations, synchronising the action between reservoir (12), packer (11) and maker (10) causes problems. In the disclosed installation, the working speed of the maker (10) and the packer (11) is controlled depending on a measured filling level of the reservoir (12). When the filling level of the reservoir (12) is low, the working speed of the maker (10) is increased, when the filling level is high, said speed is decreased. On the contrary, the working speed of the packer (11) is increased when the filling level is high but reduced when the filling level is low.

15 Claims, 4 Drawing Sheets

HANDLING INSTALLATION, IN PARTICULAR FOR CIGARETTES

BACKGROUND OF THE INVENTION

The invention relates to a system for handling articles, in particular for packaging cigarettes, having a reservoir or store for temporarily receiving articles, and having at least a first handling machine, in particular a maker for cigarettes, upstream, and at least a second handling machine, in particular a packaging machine, downstream, of the reservoir as seen in the direction of the movement path, it being the case that the first handling machine conveys articles alternatively into the reservoir or to the second handling machine and the reservoir, as required, discharges articles to the second handling machine.

In many areas of production or handling technology, different sub-assemblies and/or machines are linked up to one another to form a unit. The articles which are to be handled pass through the different machines one after the other and thus undergo the necessary processing. The sub-assemblies and machines which are combined to form such a system have to be controlled in a coordinated manner and/or co-ordinated with one another in terms of functioning.

Systems of the abovementioned type are to be found, in particular, in packaging technology. Finished products pass through in some circumstances a number of machines in order, for example, to be grouped into units and packaged in a number of steps. "Lines" which comprise a number of sub-assemblies and machines are known in the production and packaging of cigarettes. A cigarette production machine, a so-called maker, is adjoined by at least a first packaging machine. However, usually more than one packaging machine is provided, in order for a first, inner wrapping, the actual packaging and an outer, film wrapping to be provided in successive steps. It is difficult in practice to co-ordinate the machines with particularly high outputs.

It is known to use stores, so-called reservoirs, which temporarily receive a large number of cigarettes following the maker and discharge these again, as required, to the following packaging machine. It is also known in this case for the maker and packaging machine to be switched off in accordance with a maximum or minimum filling level. For example, it is customary to switch off the maker when the reservoir has reached a filling level of 100% of the maximum capacity. In the same way, the following packaging machine is switched off when the store is completely empty.

SUMMARY OF THE INVENTION

The object of the invention is to improve the performance and/or the efficiency of such systems which comprise a number of machines and sub-assemblies and use a store for articles.

In order to achieve this object, the system according to the invention is characterized by the following features:

a) the first handling machine, which is arranged upstream of the reservoir in the conveying path of the articles, and/or the second handling machine, which is arranged downstream of the reservoir, can be controlled in terms of the operating speed (cycle speed) in accordance with the filling level of the reservoir, said level being measured constantly or from time to time, b) the first handling machine, which is arranged upstream of the reservoir, can be driven at a higher output (cycle speed) when the filling level of the reservoir is comparatively low and can be driven at a correspondingly lower output (cycle speed) when the filling level of the reservoir is higher, c) the second handling machine, which is arranged downstream of the reservoir, can be driven at a lower output (cycle speed) when the filling level of the reservoir is lower and can be driven at a higher output (cycle speed) when the filling level of the reservoir is higher.

The invention is based on the idea of carrying out a constant, continuously or cyclically carried out co-ordination of the handling machines with one another with the aid of the reservoir or of the filling level of the articles in the reservoir. Furthermore, the invention is based on the finding that the operation of one handling machine has to be co-ordinated constantly or from time to time with the operation of the other, associated handling machine, in order to achieve, in terms of the system as a whole, optimum machine functioning with the smallest possible number of machine stops. The aim of the invention is to reduce the number of times individual machines, or even the system as a whole, are/is switched off and, instead, to operate the same in a co-ordinated manner, if required, with reduced output.

As reference variable for the control of the machines, use is made, according to a further feature of the invention, of an optimum filling level of the reservoir, namely an average filling level of from 40% to 60% of the maximum capacity, preferably of 50%. Deviations from this optimum filling level of the store results in a change in output of one handling machine or the other.

According to a further feature of the invention, the co-ordination, controlled via the filling level of the reservoir, of the handling machines with one another is such that the individual, current output capacity of the relevant handling machines can be taken into account. For this purpose, the handling machines and the reservoir are connected to an Industrial Personal Computer (IPC) which processes the current filling level of the store with the operating data of the machines, to be precise in accordance with a predetermined, changeable configuration. By virtue of a programming unit which can be connected to the IPC, the set configuration can be changed and adapted to the respectively current conditions. For this purpose, it is possible, for example, for a laptop to be connected to the IPC via a serial interface.

The process according to the invention can be used particularly advantageously in the cigarette industry. In this case, the first handling machine, which is arranged upstream of the reservoir, is a maker for cigarettes. The downstream, second handling machine is a (first) packaging machine.

BRIEF DESCRIPTION OF THE DRAWING

Further details of the apparatus and process according to the invention are explained in more detail hereinbelow with reference to exemplary embodiments and/or use examples, in which.

DESCRIPTION OF THE PREFERRED EMBODIMENTS

Figure 1:
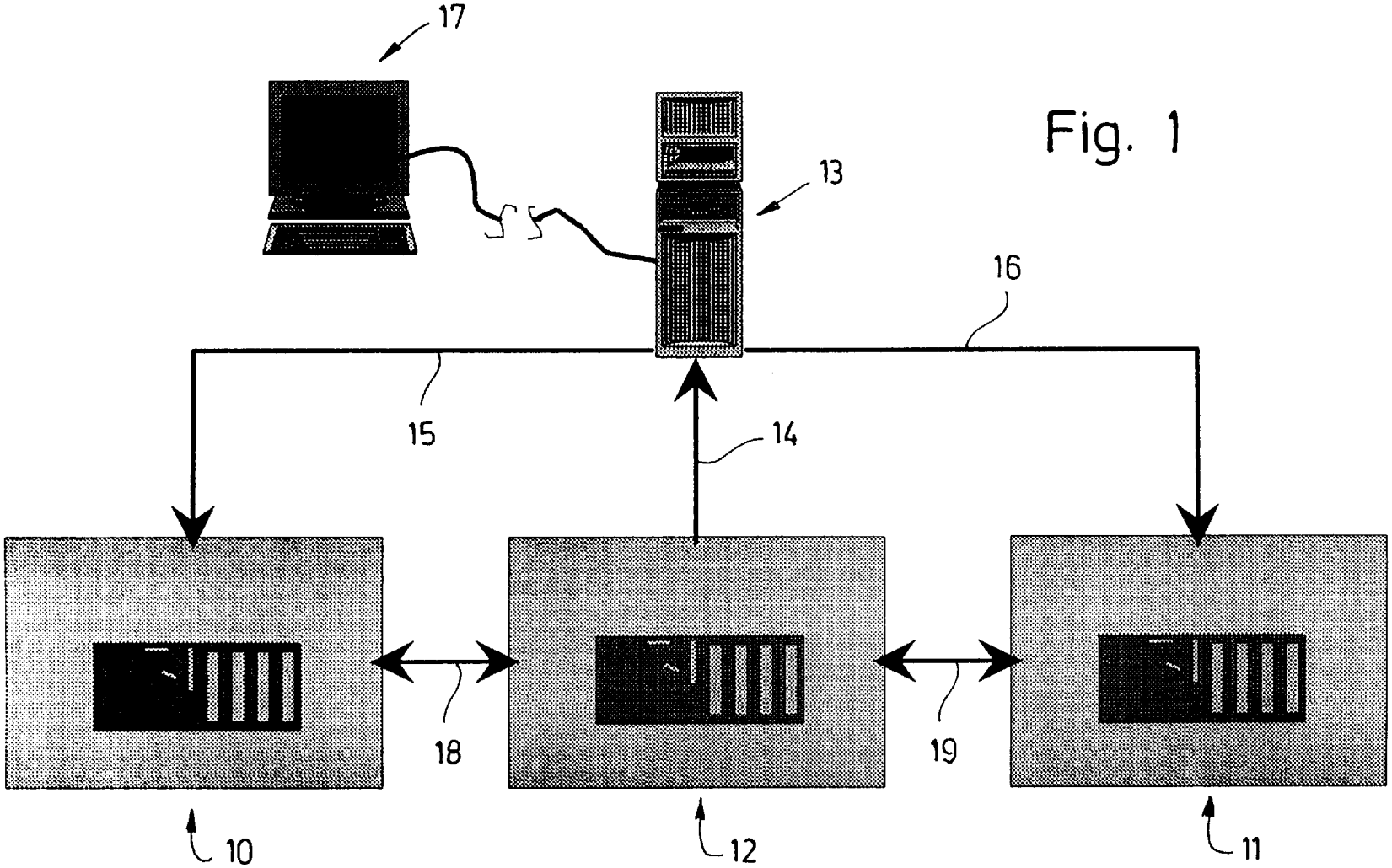
FIG. 1 shows a schematic illustration of a system with central control unit.

The details explained with reference to the drawings relate to a preferred use example, namely a system used in cigarette technology. More precisely, the invention relates to a cigarette production machine, namely a maker 10, being linked up to a (first) packer 11 for the cigarettes or for a formed cigarette group. The maker 10 is designed for a comparatively high output of, for example, up to 14,000 cigarettes per minute. The output capacity of the packer 11 is adapted to that of the maker 10. For example, the output of the packer 11 may be around 700 packs per minute. This is the case with a packer 11 of known construction for the purpose of producing hinge-lid boxes or hinge-lid packs.

A store or reservoir 12 for the cigarettes is incorporated in the conveying path of the cigarettes from the maker 10 to the packer 11. This store or reservoir is an apparatus of known construction. The reservoir 12 is designed for receiving a relatively large number of cigarettes. The cigarettes coming from the maker 10 are fed, via cigarette conveyors, to the reservoir 12 or directly to the packer 11.

The operating speeds (rotation speed or cycle speed) of the maker 10 and of the packer 11 are set with respect to one another constantly or from time to time by co-ordinated control. If the output of one machine or the other is temporarily reduced, the operating speed of the respectively other machine is correspondingly changed, namely reduced. This reduces the number of stops of an individual machine or of the system as a whole. The control of the two machines, namely of the maker 10 and of the packer 11, is effected via the filling level of the reservoir 12. The latter is monitored constantly or cyclically by suitable means.

The sub-assemblies of the system described, namely the maker 10, the packer 11 and reservoir 12, are connected to a common control unit, in the present case to an Industrial Personal Computer, that is to say an IPC 13. A control program which is geared to the respective application is stored in said IPC. The IPC 13 receives signals relating to the filling level of the reservoir via a control line 14. In accordance with the control program, control signals for the maker 10 and packer 11 are derived therefrom and fed to these machines via control lines 15, 16.

The control program stored in the IPC 13 may likewise be changed, namely adapted, for adaptation to current conditions or to changes in the controlled machines. For this purpose, a programming unit which can be connected to the IPC 13, for example a laptop 17, is provided. This unit can be connected to the IPC via a serial interface. The laptop 17 is suitable for diagnosis of the respective control program and for changing the parameters or the control algorithm. The changes or specified values for the algorithm are input into the laptop and transmitted from the latter to the IPC 13 as new parameters. The laptop may subsequently be withdrawn. The IPC 13 then carries out the speed control independently.

Figure 2:
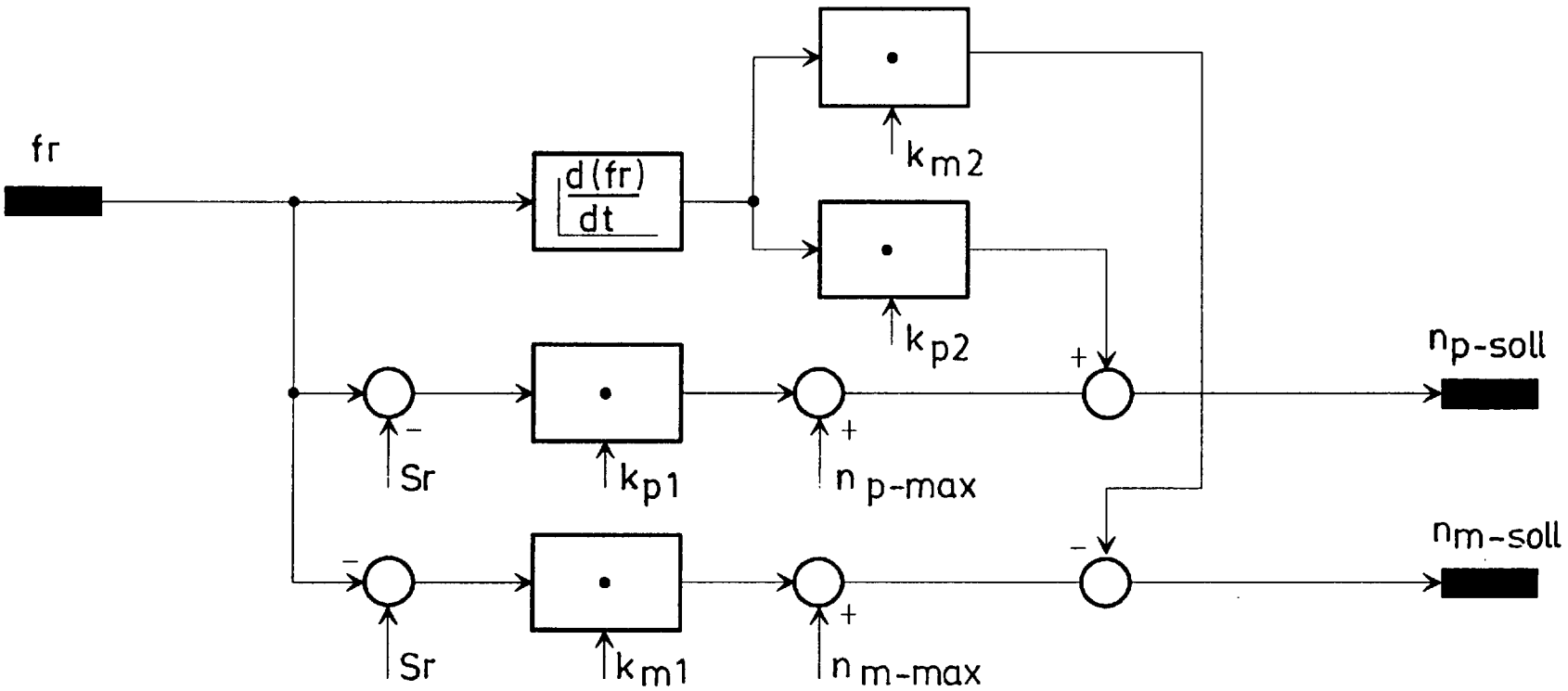
FIG. 2 shows a block diagram for the control of handling machines in dependence on the filling level of a reservoir.

As can be seen from FIG. 2, in the case of this exemplary embodiment of the control algorithm, the IPC 13 has three interfaces. A first interface relates to the filling level of the reservoir 12. This supplies signals relating to the current filling level to the IPC 13. The filling level is transmitted, for example, via an Ethernet interface.

The second interface relates to the specified rotational-speed value of the packer 11. The specified rotational-speed value calculated in accordance with the control algorithm is transmitted from the IPC 13 to the packer 11 via a four-bit BCD, 24V digital interface.

In the same way, the specified rotational-speed value is transmitted from the IPC 13 to the maker 10 via the third interface, to be precise likewise via a four-bit BCD, 24V digital interface.

In the case of the illustrated, preferred exemplary embodiment of a system for cigarettes, a standard connection remains between the reservoir 12, on the one hand, and the maker 10 and packer 11, on the other hand. So-called status signals are exchanged between these sub-assemblies of the system via control connections 18, on the one hand, and 19, on the other hand. These signals are, for example, signals for an "emergency stop", that is to say for switching off one sub-assembly or the other, for a changeover to "standby", etc.

In the case of an advantageous embodiment of the control system, the transmission of the signals from the IPC 13 to the maker 10 and packer 11 is provided with an additional bit as "sign of life". As long as this sign of life is active, the specified rotational-speed values and/or control signals coming from the IPC 13 take effect at the maker 10 and packer 11. If no activity is established at the interfaces to the IPC 13 by the maker 10 and packer 11, these machines, that is to say the maker 10 and/or packer 11, continue with the specified speed values which are transmitted via the control connections 18 and 19, that is to say in accordance with a predetermined standard program.

The control signals of the IPC 13 are transmitted via four-bit BCDs. This results in 16 available speed stages. Which bits are used for the specified speed values depends on the possible speed stages of the corresponding machine—maker 10 or packer 11.

The specified rotational-speed values, that is to say the control signals of the IPC 13, are checked at short time intervals, for example at intervals of 4 seconds. These specified values are updated in this way.

Figure 3:
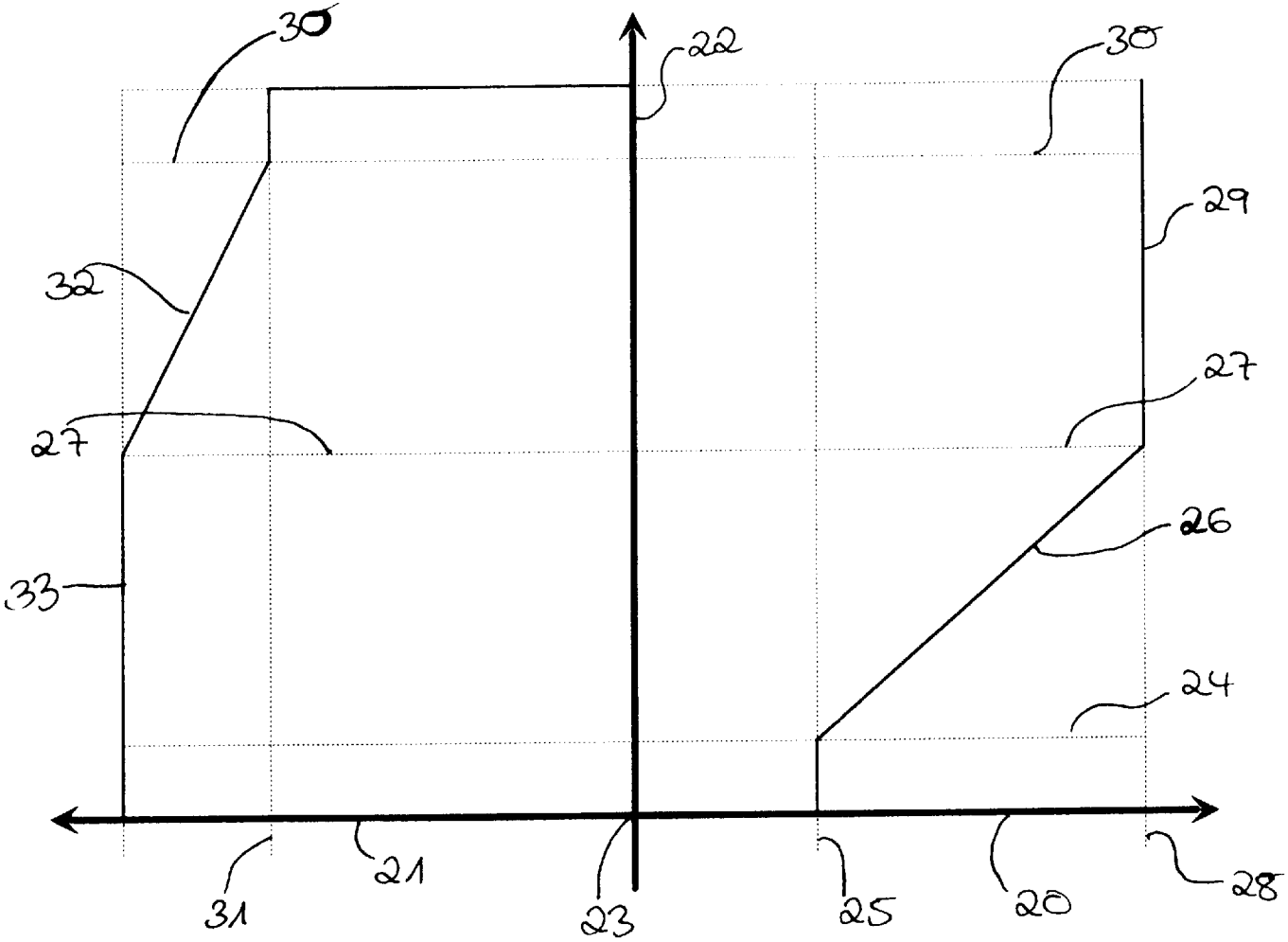
FIG. 3 shows, in the form of a graphic illustration, an exemplary embodiment for a configuration for controlling the handling machines.

FIG. 3 is a graphic illustration of a first embodiment of the configuration for the control of the maker 10 and packer 11. In a set of co-ordinate axes, the rotational speeds or output assigned to the packer 11, to be precise in accordance with the number of packs produced per minute (p/min), is plotted on the horizontal branch 20, which points to the right. A branch 21, which runs in the opposite direction, gives the respective output of the maker 10, that is to say the rotational speed of the same, expressed in number of cigarettes per minute (c/min.). A vertical line 22 is the filling level of the reservoir 12. The measurements and speeds start from a common zero point 23.

A bottom line 24 marks a minimum filling level of the reservoir 12 of, for example, 10%. If the filling level drops below this amount, the maker 10 or the packer 11 is switched off.

In the region of the minimum filling level according to line 24, the packer 11 is operated at a minimum output of, for example 250 p/min, corresponding to vertical line 25. When the filling level of the reservoir 12 rises, the output or cycle or rotational speed of the packer 11 rises (in linear fashion) along the line 26. The configuration is such that, in the present case, when the filling level of the reservoir 12 is at an optimum level of 50%, corresponding to the line 27, the maximum output of the packer 11 has been reached, corresponding to the vertical line 28, at for example 700 p/min. This output, as can be gathered from an output line 29, is maintained when the filling level of the reservoir 12 increases further.

In the same way, the maker 10 is controlled in accordance with the filling level in the reservoir 12. When there is a maximum critical filling level of, for example, 90%, corresponding to the line 30, the maker 10 is switched off in order to prevent the continued feed of cigarettes to the reservoir 12. Starting from the line 30, corresponding to this maximum filling level, the maker, when there is a reduction in the filling level, begins with the production and feed of cigarettes corresponding to line 31, which may correspond to an output of, for example, 10,000 c/min. When the filling level in the reservoir 12 is reduced further, the output of the maker 10 rises gradually corresponding to line 32 to a predetermined maximum output of, for example, 14,000 c/min, marked by line 33. This maximum output is also maintained when the filling level in the reservoir 12 is reduced further.

Figure 4:
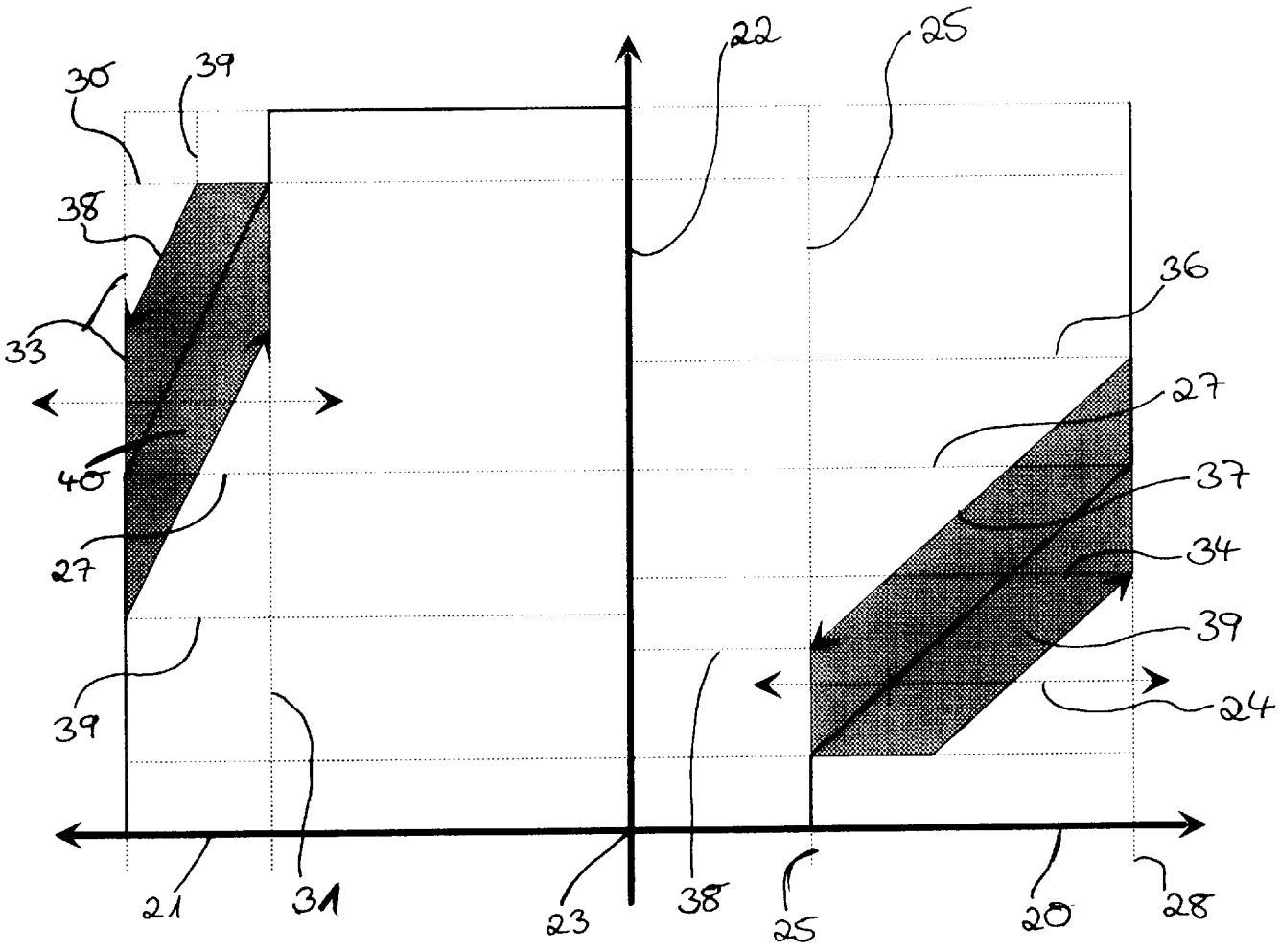
FIG. 4 shows an illustration analogous to FIG. 3 for a further-developed embodiment of the configuration.

The graphic illustration according to FIG. 4 is based on a more complex configuration for the control of the maker 10 and packer 11. The lines which correspond to the illustration according to FIG. 3 have been carried over. As can be seen, the rise in the output of the packer 11—starting from a critical minimum filling level according to line 24—begins at a higher rotational speed or output, corresponding to line 34. This corresponds, for example, to an output of 400 or 500 p/min. The rise in the output is selected such that even at a filling level below the optimum filling level, corresponding to line 27, the maximum output of the packer 11 has been reached, namely at a line 35, which may correspond to a filling level of, for example, 30% or 35% of the reservoir 12. This configuration is based on the finding that, when the filling level in the reservoir 12 rises, it is expedient to have a higher output and for the maximum output to be reached more quickly in the case of the packer 11.

In the opposite direction, namely when the filling level in the reservoir 12 falls, at the line 36, that is to say above the optimum filling level according to line 27, for example at 60% or 70% filling level in the reservoir 12, the output of the packer 11 is reduced and, corresponding to the line 37, brought down to a minimum output, corresponding to vertical line 25. In this case, this minimum output is achieved at approximately 25%, corresponding to line 38. A further reduction in the output is not envisaged.

The maker 10 is operated in the same way in accordance with this configuration. When the filling level of the reservoir 12 tends to fall, the maker 10 is controlled corresponding to line 38. This means that when the filling level drops below the critical maximum filling, corresponding to line 30, the maker 10 resumes the production operation at an output of, for example, 12,000 c/min corresponding to line 39. The maximum output, corresponding to line 33, is achieved more quickly, namely still above the optimum filling level, corresponding to line 27 (50%).

Conversely, when a rise in the filling level in the reservoir 12 is established, the maker 10, starting from a minimum filling, below the optimum filling level—line 27—is changed over to reduced output, namely at approximately 30% filling level, corresponding to the line 39. Starting from here, the maker 10 is brought back, in terms of the output, to the minimum output, corresponding to line 31, at for example 10,000 c/min.

Other configurations are possible if required and can be input into the control unit or into the IPC 13 in the manner described. There is thus no need for a linear, that is to say straight-line, progression of the changes in output of the maker 10, on the one hand, and the packer 11, on the other hand, in the case of the exemplary embodiment of FIG. 4, within the region delimited by the obliquely running lines. Rather, it is possible to introduce a further dependency, which can be gathered, in principle, from the block diagram of FIG. 2. In accordance with this, it is possible, within the surface areas 39 and 40 marked in FIG. 4, to have an arcuate or even irregular progression of the rising or falling lines of the outputs of the maker 10 or packer 11, depending on the configuration stored in the IPC 13.

The block diagram according to FIG. 2 illustrates the control concept of the apparatus according to the invention. The rotational speeds of the maker $n_{m\text{-}des}$ and of the packer $n_{p\text{-}des}$ are controlled or regulated on the basis of the filling level of the reservoir $f_r$. In this case, the procedure is as follows:

For the controlled rotational speed of the maker $n_{m\text{-}des}$, the current filling level of the reservoir $f_r$ is measured and calculated along with a predetermined desired filling level $f_r$ of the same. The difference between these two variables is formed for this purpose. This difference is multiplied by a first constant, namely a control parameter or a static factor $k_{m1}$. This gives a proportional component of the control algorithm. In parallel with this, the measured filling level of the reservoir $f_r$ is differentiated and multiplied by a second constant, namely the control parameter or a dynamic factor $k_{n2}$. This gives the differential component of the control algorithm. The proportional component and the differential component are then calculated along with the maximum rotational speed of the maker $n_{m\text{-}max}$ to give the desired rotational speed $n_{m\text{-}des}$ of the same. For this purpose, the proportional component is added to the maximum rotational speed of the maker, but the differential component is substracted therefrom. The control algorithm for the rotational speed of the maker $n_{m\text{-}des}$ is expressed overall by the following formula:

$$n_{m\text{-}des} = n_{m\text{-}\max} + k_{m1} * (s_r - f_r) - k_{m2} * \left(\frac{d(f_r)}{dt}\right)$$

The procedure is the same for the control of the rotational speed of the packer $n_{p\text{-}des}$. Starting from the current filling level of the reservoir $f_r$, a proportional component $k_{p1}*(f_r - s_r)$ and a differential component $$k_{p2} * \left(\frac{d(f_r)}{dt}\right)$$

of the control algorithm for the rotational speed of the packer $n_{p\text{-}des}$ are calculated. The proportional component and differential component are then calculated along with the maximum rotational speed $n_{p\text{-}max}$ for the packer. This is done using the following formula:

$$n_{p\text{-}des} = n_{p\text{-}\max} + k_{p1} * (f_r - s_r) + k_{p2} * \left(\frac{d(f_r)}{dt}\right)$$

Accordingly, overall, both the rotational speed of the maker $n_{m\text{-}des}$ and the rotational speed of the packer $n_{p\text{-}des}$ are calculated in accordance with a proportional-differential control algorithm.

List of Designations

10 Maker
11 Packer
12 Reservoir
13 IPC
14 Control line
15 Control line
16 Control line
17 Laptop
18 Control connection
19 Control connection
20 Branch
21 Branch

22 Line
23 Zero point
24 Line
25 Vertical line
26 Line
27 Line
28 Vertical line
29 Output line
30 Line
31 Line
32 Line
33 Line
34 Line
35 Line
36 Line
37 Line
38 Line
39 Surface area
40 Surface area

What is claimed is:

1. System for handling articles, having a reservoir (12) or store for temporarily receiving articles, and having at least a first handling machine upstream, and at least a second handling machine downstream, of the reservoir (12) as seen in the direction of a conveying path, of the articles it being the case that the first handling machine conveys articles alternatively into the reservoir (12) or to the second handling machine and the reservoir (12), as required, discharges articles to the second handling machine, it being the case that a) the first handling machine, which is arranged upstream of the reservoir (12) in the conveying path of the articles, and the second handling machine, which is arranged downstream of the reservoir (12), can be controlled in terms of the operating speed (cycle speed, output) in accordance with the filling level of the reservoir (12), said level being measured constantly or from time to time, b) the first handling machine, which is arranged upstream of the reservoir (12), can be driven at a higher speed when the filling level of the reservoir (12) is comparatively low and can be driven at a correspondingly lower operating speed when the filling level of the reservoir (12) is higher, c) the second handling machine, which is arranged downstream of the reservoir (12), can be driven at a lower operating speed (output, cycle speed) when the filling level of the reservoir (12) is lower and can be driven at a higher operating speed when the filling level of the reservoir (12) is higher,
characterized in that d) the operating speeds of the first and/or second handling machine (10; 11) can be set both in dependence on the measured filling level ($f_r$) and in dependence on the tendency of the filling level to change.

2. System according to claim 1, characterized in that the control of the machines arranged upstream and downstream of the reservoir (12) is geared to an optimum filling level of the reservoir (12).

3. System according to claim 1, characterized in that the handling machine arranged upstream of the reservoir (12) is switched off when a maximum filling level of the reservoir (12) has been reached, and the handling machine arranged downstream of the reservoir (12) is switched off when the filling level of the reservoir is at a minimum level, which can be set.

4. System according to claim 1, characterized in that, when a change is established in the filling level in the reservoir (12), with the filling level tending to rise, that is to say increase, the downstream handling machine (packer 11) is started up and/or operated at an increased operating speed (output) and with the filling level in the reservoir (12) tending to fall, with the relatively high filling level, above the optimum filling level, said handling machine can be changed over to reduced output.

5. System according to claim 1, characterized in that, when the filling level in the reservoir (12) changes in the downward direction, the first handling machine (maker 10) is operated at a relatively high operating speed (output) and, when the filling level changes in the upward direction, said handling machine is started up below the optimum filling level.

6. System according to claim 1, characterized in that the handling machines (maker 10, packer 11) can be controlled by a central control unit.

7. System according to claim 6, characterized in that the sub-assemblies of a system are additionally connected to one another by standard control connections (18, 19) for the purpose of transmitting standard data.

8. The system according to claim 1, wherein the tendency of the filling level to change is a differential component $$\left(\frac{d(f_r)}{dt}\right)$$

of the filling level ($f_r$).

9. The system according to claim 2, wherein the optimum filling level of the reservoir (12) is from 40% to 60%.

10. The system according to claim 9, wherein the optimum filling level is 50%.

11. The system according to claim 3, wherein said maximum filling level is approximately 100%.

12. The system according to claim 3, wherein said minimum level occurs when said reservoir is completely empty.

13. The system according to claim 6, wherein said central control unit is an Industrial Personal Computer—IPC (13).

14. The system according to claim 7, wherein said sub-assemblies comprise a cigarette maker (10), a cigarette packer (11) and said reservoir.

15. The system according to claim 14, wherein said standard data are transmitted when said control means fails.

* * * * *